United States Patent [19]

Strozinski

[11] 3,974,703

[45] Aug. 17, 1976

[54] COMBINATION RETURN AND MESH SPRING-PLUNGER POLE MOTOR

[75] Inventor: Anthony John Strozinski, Horseheads, N.Y.

[73] Assignee: Facet Enterprises, Inc. Motor Components Division, Elmira, N.Y.

[22] Filed: Aug. 26, 1975

[21] Appl. No.: 607,744

[52] U.S. Cl. ..... 74/6; 123/179 M; 290/37 R

[51] Int. Cl.[2] ..... F02N 1/00

[58] Field of Search ..... 123/179 R, 179 M; 74/6; 290/37 R, 38

[56] References Cited

UNITED STATES PATENTS

| | | | |
|---|---|---|---|
| 2,235,076 | 3/1941 | McGrath | 74/6 |
| 2,839,935 | 6/1958 | Hartzell et al. | 74/6 |
| 3,280,811 | 10/1966 | Baker et al. | 123/179 M |
| 3,708,682 | 1/1973 | Erwin, Jr. | 290/38 |

FOREIGN PATENTS OR APPLICATIONS

| | | | |
|---|---|---|---|
| 603,940 | 8/1960 | Canada | 290/38 |

*Primary Examiner*—Wendell E. Burns
*Assistant Examiner*—David D. Reynolds
*Attorney, Agent, or Firm*—Remy J. VanOphe

[57] ABSTRACT

A starter drive for an internal combustion engine has a plunger pole starting motor drivably connected to a pinion adapted to engage the ring gear on the engine when cranking the engine. A shift fork is pivotally mounted on a lever arm connected to the plunger pole and a single spring urges the shift fork to position the pinion in cranking position when the motor is energized and returns the shift fork to position the pinion in non-cranking position when the motor is deenergized. Space is made available for a cushioning device between the motor and pinion to absorb starting torque.

7 Claims, 3 Drawing Figures

COMBINATION RETURN AND MESH SPRING-PLUNGER POLE MOTOR

The invention relates to starter drives for use on internal combustion engines.

BACKGROUND OF THE INVENTION

Plunger pole starting motors as used heretofore use a rigid lever arm and shift fork actuated by a plunger pole for meshing the starter pinion with the ring gear on the engine when starting the engine. This arrangement requires a return spring and a separate mesh enforcing spring which is usually located ahead of the shift collar. Since space in starters of this kind is at a premium it is not presently practical to use an auxillary cushioning device to absorb starting torque.

SUMMARY OF THE INVENTION

The present invention relates to a plunger pole starting motor which includes an auxillary cushioning device in the space heretofore occupied by the mesh enforcing spring to absorb starting torque. This space is made available by pivotally attaching the shift fork to the lever arm and using a single spring for meshing the pinion with the ring gear when the plunger pole starting motor is energized and for disengaging the pinion from the ring gear when the plunger pole starting motor is deenergized.

The invention contemplates a starter drive adapted for use with an internal combustion engine and having a starting motor with a plunger pole, means for drivably connecting the starting motor to the engine for cranking the engine when the motor is energized including a lever arm connected to the plunger pole and a shift fork pivotally attached to the lever arm, and a single spring for moving the shift fork into cranking position when the motor is energized and for returning the shift fork and lever arm to non-cranking position when the motor is deenergized.

DRAWING

FIG. 1 is a side view partially in section showing a starter in deenergized position constructed according to the invention, FIG. 2 is a view somewhat similar to FIG. 1 showing a portion of the starter when energized prior to the pinion meshing with the ring gear, and FIG. 3 is a view similar to FIG. 2 showing the pinion meshing with the ring gear after the starting motor begins rotating.

DETAILED DESCRIPTION OF THE INVENTION

Figure 1:
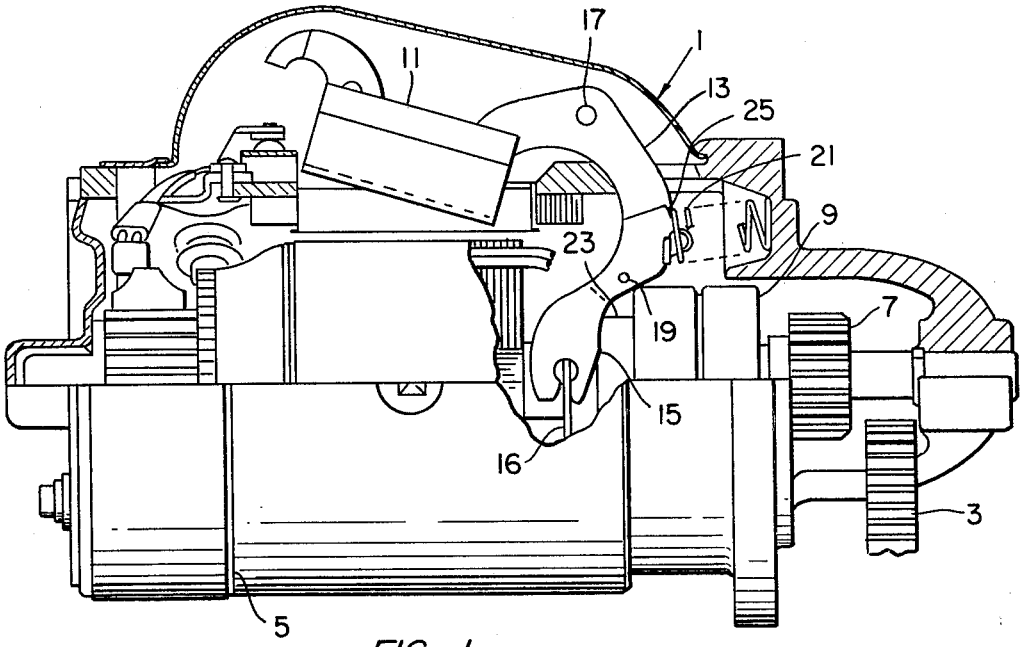

Referring to the drawing, a starter drive 1 constructed according to the invention is shown therein for use on an internal combustion engine having a ring gear 3. Referring to FIG. 1, the starter drive 1 includes a plunger pole starting motor 5 drivably connected to a pinion 7 by a roller clutch 9. Motor 7 has a plunger pole 11 operatively connected by a lever arm 13 pivoted on a pin 17 to a shift fork 15. The shift fork is pivoted on a pin 19 attached to the lever arm. Shift fork 15 engages a shift collar 16 for moving pinion 7 axially to mesh with ring gear 3.

A spring 21 exerts a force on both lever arm 13 and shift fork 15 and operates as a return spring when motor 5 is deenergized and as a mesh enforcing spring when the motor is energized. A cushioning device 23 of rubber or other suitable material for absorbing starting torque may be positioned between shift collar 16 and roller clutch 9.

OPERATION

Figure 2:
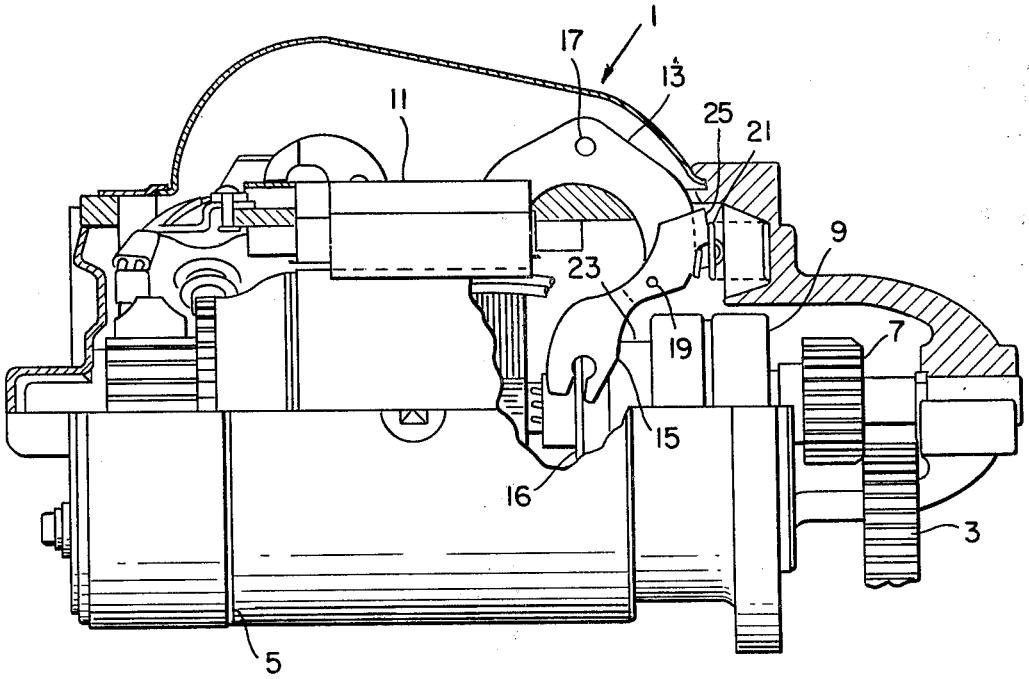
Figure 3:
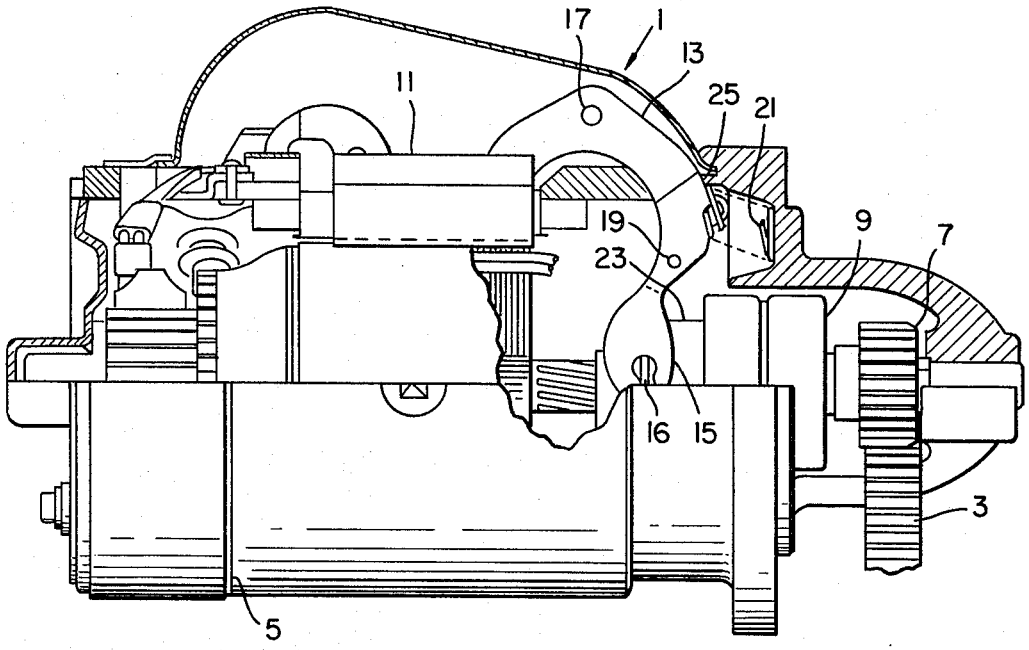

When starting motor 5 is deenergized pinion 7 is disengaged from ring gear 3 and plunger pole 11 and lever arm 13 and shift fork 15 are in the position shown in FIG. 1. When starting motor 5 is energized plunger pole 11 moves to the position shown in FIG. 2 and pivots lever arm 13 and shift fork 15 about pin 17 and compresses spring 21. Shift fork 15 moves shift collar 16 until the teeth on pinion 7 engage the teeth on ring gear 3. This prevents further movement of shift collar 16 and shift fork 15 pivots on pin 19 and the surface 25 on shift fork 15 protruding beyond lever arm 13 further compresses spring 21 so that the spring exerts a force on shift fork 15 independently of the lever arm. As starting motor 5 rotates the teeth on pinion 7 mesh with the teeth on ring gear 3 and spring 21 pivots shift fork 15 on pin 19 to move pinion 7 axially into driving engagement with ring gear 3 for starting the engine as shown in FIG. 3.

When starting motor 5 is deenergized, spring 21 pivots lever arm 13 and shift fork 15 on pin 17 to disengage pinion 7 from ring gear 3 and move plunger pole 11 to the position shown in FIG. 1

A starter drive constructed according to the invention permits the use of a cushioning device to absorb starting torque ahead of the shift collar by using a single spring for disengaging the pinion from the ring gear when the motor is deenergized and for meshing the pinion with the ring gear and maintaining the pinion in meshed position when the motor is energized.

What is claimed is:

1. A starter drive adapted for use with an internal combustion engine and having a starting motor with a plunger pole, means for drivably connecting the starting motor to the engine for cranking the engine when the motor is energized including a lever arm connected to the plunger pole and a shift fork pivotally attached to the lever arm, and a single spring for moving the shift fork into cranking position when the motor is energized and for returning the shift fork and lever arm to non-cranking position when the motor is deenergized.

2. A starter drive as described in claim 1 in which the means for drivably connecting the starting motor to the engine for cranking the engine includes a cushioning device to absorb starting torque.

3. A starter drive as described in claim 1 in which the spring is positioned and arranged to exert a force on the shift fork independently of the lever arm to move the shift fork into cranking position and exert a force on both the lever arm and shift fork to move the lever arm and shift fork to non-cranking position.

4. A starter drive as described in claim 3 in which the shift fork includes a surface which protrudes beyond the lever arm and is engaged by the spring when the shift fork pivots relative to the lever arm upon energization of the starting motor.

5. A starter drive as described in claim 1 in which the engine has a ring gear and the means for drivably connecting the starting motor to the engine includes a pinion adapted to mesh with the ring gear when cranking the engine, the shift fork moving the pinion into engagement with the ring gear when the starting motor is energized and the shift fork being arranged to pivot on the lever arm when the pinion is out of mesh with the ring gear and the spring being arranged to pivot the shift fork into cranking position when the pinion meshes with the ring gear.

6. A starter drive as described in claim 5 in which the shift fork includes a surface which protrudes beyond the lever arm and is engaged by the spring when the shift fork pivots relative to the lever arm upon energization of the starting motor.

7. A starter drive as described in claim 5 in which the means for drivably connecting the starting motor to the engine for cranking the engine includes a cushioning device between the motor and pinion to absorb starting torque.

* * * * *